United States Patent [19]

Rodman

[11] Patent Number: 4,785,981

[45] Date of Patent: Nov. 22, 1988

[54] JEWELRY ARMBAND WITH INVISIBLE STORAGE COMPARTMENT

[76] Inventor: Harry Rodman, 2500 Johnson Ave., New York, N.Y. 10463

[21] Appl. No.: 946,941

[22] Filed: Dec. 29, 1986

[51] Int. Cl.[4] ..... A44C 11/00

[52] U.S. Cl. ..... 224/165; 63/19; 224/170

[58] Field of Search ..... 63/3, 19, 9; 224/267, 224/219, 180, 164, 165, 170, 171; D11/3; D10/32

[56] References Cited

U.S. PATENT DOCUMENTS

| | | | |
|---|---|---|---|
| 1,455,840 | 5/1923 | Hill | 63/19 |
| 2,004,685 | 6/1935 | Best | D10/32 |
| 2,545,267 | 3/1951 | Donle | 63/19 |
| 2,796,747 | 6/1957 | Ebert | 63/19 |
| 2,954,622 | 10/1960 | Moore | D10/32 |
| 3,680,751 | 8/1972 | Brook | 224/219 |
| 3,780,918 | 12/1973 | Curtis | 224/165 |
| 3,924,304 | 12/1975 | Grandmont | 224/165 |

*Primary Examiner*—Richard J. Johnson
*Attorney, Agent, or Firm*—Lilling & Greenspan

[57] ABSTRACT

A watch band, or other jewelry band to be worn around the arm, has, at each end, a receptacle connected to a jewelry piece, such as a watch. Each receptacle has a door which is normally locked and can be selectively opened to expose the interior of a storage compartment such for insertion of a photograph, pills or other medicinals, or the like, which are to be carried.

12 Claims, 1 Drawing Sheet

JEWELRY ARMBAND WITH INVISIBLE STORAGE COMPARTMENT

BACKGROUND OF THE INVENTION

1. Field of the Invention

This invention generally relates to items of jewelry and, more specifically, to watch bands and bracelets provided with inconspicuous storage compartments for photographs, medicinals etc. and the like.

2. Description of Prior Art

There are untold numbers of designs for watch bands, bracelets, and similar items of jewelry which are worn around a person's arm. Some of the designs are primarily concerned with the aesthetics or looks of the item, while others are intended to provide practical, utilitarian or functional benefits. Watch bands, bracelets, and the like, however, have not been utilized to provide a simple and convenient place to store items frequently carried by individuals. For example, people usually carry photographs of their family or loved ones in their wallets, special lockets or, of course, in small frames. Similarly, those people who must periodically take medications carry pills, tablets or the like in special boxes made for that purpose. The problem, however, is that all too frequently people forget to take their wallets or pill boxes with them or forget to insert a picture that they wish to carry with them into their wallets. Also, looking at a picture in a wallet or removing a pill or tablet from a pill box is not always easy or convenient. The wallet or pill box must first be located, a sometimes frustrating experience, particularly in a multi-pocket garment such as a suit. Additionally, because these items are not secured to the person, it is also possible that the pill box, for example, can inadvertently be lost or misplaced and, of course, this is particulary troublesome when a medicine must be regularly taken at certain times of the day.

SUMMARY OF THE INVENTION

In order to overcome the above described disadvantages, it is an object of the present invention to provide an item of jewelry to be worn about the arm which is simple in construction and economical to manufacture, and which provides a storage compartment for photographs, medicinals, or the like.

It is another object of the present invention to provide such a band as suggested which is normally secured to the person so that it cannot be lost or misplaced.

It is still another object of the present invention to provide a jewelry armband, such as a watch or bracelet, of the type under discussion which provides simple and convenient access to the interior of the storage compartments for showing a photograph, withdrawing a pill or tablet, or the like.

In order to accomplish the above objects, as well as others which will become apparent hereafter, a jewelry band to be worn about the arm in accordance with the present invention generally defines oppositely facing external and internal surfaces. Said internal surface faces outwardly and being accessible and visible when the band is worn around the arm. Said internal surface facing inwardly and abuts against the arm when worn. The band includes at least one receptacle disposed along the length of the band, said receptacle having a door mounted for movement between an open condition for exposing the interior of said receptacle in the direction of said external surface in a closed condition for concealing the interior of said receptacle and preventing any item placed within said receptacle from falling out. Locking means are provided for selectively locking said door in said closed condition and for releasing said door for movement to said open condition.

In accordance with a preferably preferred embodiment, two receptacles are provided one located at each end of the band, and each receptacle being provided with a pivotaly mounted door which can be manually opened. Advantageously, however, a suitable spring is provided for biassing the door to the open position so that mere actuation of a catch results in the opening of the receptacle and exposure of its internal compartment.

BRIEF DESCRIPTION OF THE DRAWINGS

The foregoing and other features of the present invention will be more readily apparent from the following detailed description and drawings of an illustrative embodiment of the invention in which:

FIG. 5 is an enlarged prospective view of one of the receptacles of the previous figures, shown with the door in the open position to illustrate the internal storage compartment of the receptacle for storing, in accordance with the present invention, a photograph, medicinals or the like.

DESCRIPTION OF A PREFERRED EMBODIMENT

Figure 1:
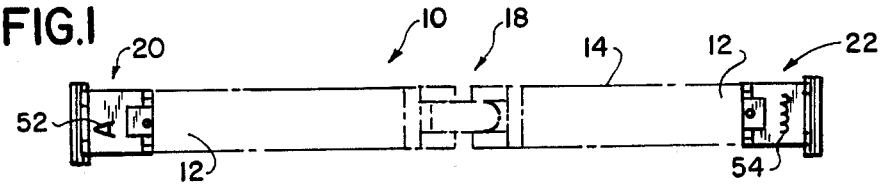
FIG. 1 is a top plan view of a watch band in accordance with the present invention, showing the external surface thereof.
Figure 2:
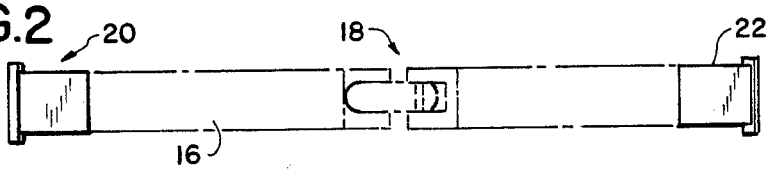
FIG. 2 is a bottom plan view of the watch band shown in FIG. 1, showing the internal surface thereof.

Referring now specifically to the figures, in which similar or identical parts have been designated by the same reference numerals throughout, and first referring to FIGS. 1 and 2, a watch band in accordance with the present invention is generally designated by the reference numeral 10. While the present invention will be specifically described in terms of a watch band, it will be immediately appreciated that the invention can be used in conjunction with any jewelry band which can be worn about the arm, including bracelets or the like.

The watch band 10 is, as most watch bands, generally flat and elongate, and has opposing ends 12. Referring to FIG. 1, the external surface 14 of the watch band 10 can be seen in the top plan view, which external surface faces outwardly and is accessible and visible when the band is worn around the arm. In FIG. 2, the opposing internal surface 16 is shown which faces inwardly and normally abuts against the arm when the watch band is worn. Any conventional latch or lock 18 may be used to facilitate the closing of the watch band 10 around the arm and for removing the band. While a clip-type latch is shown, any other conventional device may be used, such as a buckle. The latch 18 is, in fact, optional and may be totally eliminated if the watch band 10 is expandable so that it can be expanded or stretched sufficiently to permit passage of the hand through it when the band is placed on or taken off of the arm.

An important feature of the present invention is the provision of at least one receptacle disposed along the length of the band. In the embodiment being described, two receptacles 20, 22 are provided one at each end 12 of the watch band 10. It should be evident, however, that the receptacles 20, 22 may be provided at any desired position between the ends 12 of the watch band.

Figure 3:
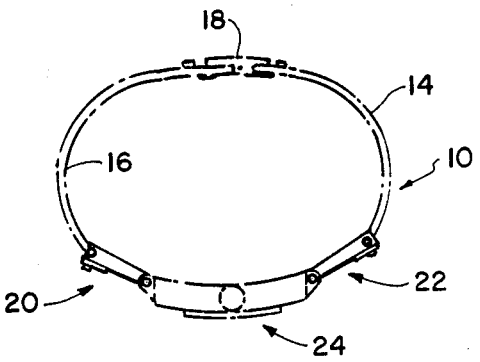
FIG. 3 is a side elevational view of the watch band shown in FIGS. 1 and 2, showing the manner in which the watch band is attached to a watch.
Figure 4:
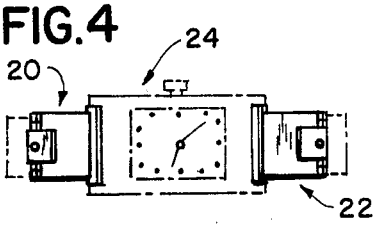
FIG. 4 is a top plan view of the watch shown in FIG. 3, showing the relative locations of the storage compartments in accordance with the present invention.

Referring to FIGS. 3 and 4, the watch band 10 is shown connected to a jewelry piece 24, shown in the these figures to be a watch. The jewelry piece 24 is connected to the receptacles 22, as will be more fully described in connection with FIG. 5. The jewelry piece 24 together with the optional latch 18 produces the circular loop appropriately sized to be worn about the arm. As suggested above, however, the latch 18 is optional as is the jewelry piece 24. In the instance of an expandable or stretchable bracelet, for example, one or both receptacles 20, 22 may be used without any additional adorning jewelry piece 24. In this connection, it may also be noted that more than two receptacles may be used and, in fact, it is also possible to create a bracelet, for example, made up completely of a series of connected receptacles to create a bracelet. The invention contemplates, therefore, the use of at least one receptacle, although two or more such receptacles may be used and connected to each other in any conventional way.

Figure 5:
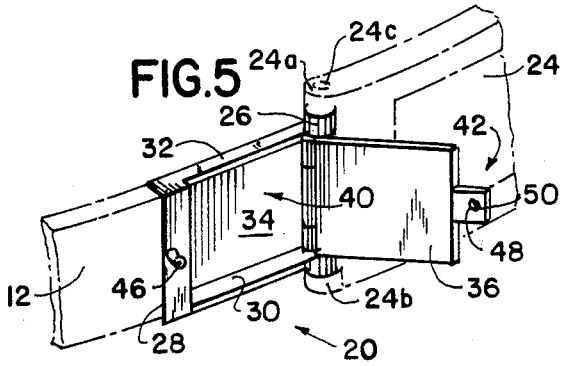

Referring to FIG. 5, the details of the receptacle 20 are shown. The description of the receptacle 20 is the also applies to the receptacle 22 since the two are identical in construction, with the possible exception that they are mirror images of each other, since they are disposed on opposite sides of the jewelry piece 24.

In FIG. 5, the watch 24 is shown to be provided with opposing pin retaining lugs **24*a*, 24*b* and a retractable pin 24*c*, all of which are conventional. In accordance with one approach for attaching the receptacle 20 to the watch 24, there is provided, at one end of the receptacle, a pin receiving tubing 26 dimensioned to fit between the lugs 24*a*, 24*b* and receive the retractable pin 24*c*, similarly to such tubings used on most watch bands. The opposing end 28 of the receptacle 20 is attached to the end 12 of the watch band 10** in any conventional manner.

The receptacle 20 is provided with side walls 30, 32 which determine the depth or thickness of the receptacle 20 and a bottom wall 34 which is substantially coextensive with the internal surface 16 of the watch band.

The receptacle 20 has a door 36 which is mounted for movement between an open condition, as shown in FIG. 5, for exposing the interior compartment 40 of the receptacle, and a closed condition for concealing the interior or compartment 40 and preventing any items placed within the receptacle from falling out. In FIG. 5, the door 36 is shown to be pivotally mounted. However, the specific method by which the door is mounted is not critical as long as it can be selectively and conveniently opened and closed. The door 36 may be moved between the opened and closed conditions manually. Advantageously, however, suitable biassing means are provided, such as a spring, for urging the door to the open condition once it has been unlocked or unlatched. The specific methods for biassing a door in this manner is well known in the jewelry art.

Appropriate locking means is provided for selectively locking the door in the closed condition and for releasing the door for movement to the open condition. In FIG. 5, such locking means comprises a snap pin 46 mounted at the end 28 of the receptacle and a corresoonding snap 48 having a hole 50 dimensioned to receive and release the snap pin 46 upon application of predetermined pressure. Such snap locking devices are well known in the art, and any other locking arrangements may be used, including magnetic means, latches, or the like.

In the embodiment disclosed, the receptacles 20, 22 are shown to be generally rectangular and shallow and ideal for receiving a photograph which can be readily and conveniently exposed to be viewed. The receptacles 20, 22 may also be used to receive small pills or tablets or other medications. If necessary, the walls 30, 32 may be made somewhat higher so as to provide greater depth to the receptacles for accepting slightly larger pills, tablets or other items which are to be on the person at all times.

Advantageously, the receptacles 20, 22 are designed in a way to make same totally inconspicuous so as not to draw attention to the fact that the watch band does contain hidden receptacles or compartments. Thus, by using appropriate latches or locks for the moveable doors 36, the receptacles can be made to appear as mere continuations of the watch band or a part of the watch or bracelet. By rendering the internal compartments 40 inconspicuous or invisible, the receptacles 20, 22 can also serve as secret storage compartments for secret or confidential information, luggage keys, coins, etc.

The top or upper surfaces of the receptacles 20, 22 may also be engraved with initials 52 or provided with emblems 54, both for decorative purposes as well as to further camouflage the nature of the receptacles.

While the invention is described with reference to specific embodiments thereof and with respect to the incorporation therein of certain combinations of features, it is to be understood that the invention may be embodied in other forms, many of which do not incorporate all of the features present in this specific embodiment of this invention which has been described. For this reason, the invention is to be taken and limited only as defined by the claims that follow.

What is claimed is:

1. A jewelry band to be worn around the arm generally defining oppositely facing external and internal surfaces, said external surface facing outwardly and being accessible and visible when the band is worn around the arm, and abutting against the arm when worn, the band including at least one receptacle disposed along the length of the band, said receptacle having a door mounted for movement between an open condition for exposing the interior of said receptacle in the direction of said external surface, and a closed condition for concealing the interior of said receptacle and preventing any item placed with said receptacle from falling out; and locking means for selectively locking said door in said closed condition and for releasing said door for movement to said open condition; the band comprising a watch band having opposing ends attachable to a watch, said at least one receptacle being disposed at one end of said watch band and being provided with connecting means for connecting said at least one receptacle to a watch, said at least one receptacle being provided with pin receiving means for receiving a pin extending between opposing lugs of a watch, said door being mounted on said pin between said opposing lugs.

2. A jewelry band as defined in claim 1, wherein said door is pivotally mounted and is adapted to pivot between said open and closed conditions.

3. A jewelry band as defined is claim 1, further comprising biassing means for biassing said door to said open condition.

4. A jewelry band as defined in claim 3, wherein said biassing means comprises a spring.

5. A jewelry band as defined in claim 1, wherein the band comprises a watch band.

6. A jewelry band as defined in claim 1, wherein the band comprises a bracelet.

7. A jewelry band as defined in claim 1, wherein two receptacles are disposed along the length of the band.

8. A jewelry band as defined in claim 2, wherein said at least one receptacle is generally rectangular and dimensioned to receive a photograph.

9. A jewelry band as defined in claim 1, wherein said at least one receptacle is dimensioned to receive medication tablets.

10. A jewelry band as defined in claim 1, wherein said at least one receptacle has a display surface suitable for application of emblems, engraved initials or the like, said surface facing the same direction as said external surface of said jewelry band.

11. A jewelry band as defined in claim 10, further comprising means defining an emblem on said display surface.

12. A jewelry band as defined in claim 10, further comprising means defining letters applied to said display surface.

* * * * *